US005315927A

United States Patent [19]

Yeh

[11] Patent Number: 5,315,927

[45] Date of Patent: May 31, 1994

[54] AUTOMATIC PRINTING APPARATUS FOR A PACKING CASE CARRIED ON A CONVEYOR BELT UNIT

[76] Inventor: Chin-Chen Yeh, No. 6, Lane 129, Min-Tsu Rd., Changhua City, Taiwan

[21] Appl. No.: 986,002

[22] Filed: Dec. 4, 1992

[51] Int. Cl.[5] ..... B65B 61/26

[52] U.S. Cl. ..... 101/35; 101/44; 101/DIG. 30; 53/131.2

[58] Field of Search ..... 101/35, 36, 37, 41, 101/42, 43, 44, DIG. 30; 53/131.2, 131.3, 131.4

[56] References Cited

U.S. PATENT DOCUMENTS

| | | | |
|---|---|---|---|
| 2,819,669 | 1/1958 | Glunz | 101/35 |
| 3,606,162 | 9/1971 | Lehmann | 101/35 |
| 3,730,133 | 5/1973 | Cordiano et al. | 101/35 |
| 3,867,882 | 2/1975 | Ahlgren et al. | 101/35 |
| 3,960,072 | 6/1976 | Ahlgren et al. | 101/35 |
| 4,033,254 | 7/1977 | Tobey et al. | 101/44 |
| 4,214,520 | 7/1980 | Eissel | 101/42 |
| 5,033,196 | 7/1991 | Akin et al. | 101/35 |

FOREIGN PATENT DOCUMENTS

| | | | |
|---|---|---|---|
| 845944 | 7/1981 | U.S.S.R. | 101/35 |

*Primary Examiner*—J. Reed Fisher
*Assistant Examiner*—Stephen R. Funk
*Attorney, Agent, or Firm*—Fisher & Associates

[57] ABSTRACT

An automatic printing apparatus is used to print indentifying words on a packing case that is carried on a conveyer belt unit and includes a sensor, a lower support unit, a lengthwise-position adjustment device, an upper support unit, a height adjustment device, a feeding hydraulic cylinder, a printer support unit, a contact switch, a printing hydraulic cylinder and a printer member. The printer member is carried on the printer support unit. The printer support unit is carried on the upper support unit. The upper support unit is carried on the lower support unit. The lengthwise-position adjustment device can be actuated to adjust the position of the lower support unit along the length of the conveyer belt unit. The height adjustment device can be actuated to adjust the vertical position of the upper support unit relative to the lower support unit. When the packing case is moved to align with the sensor, the sensor activates the feeding hydraulic cylinder so as to move the printer support unit toward the packing case.

1 Claim, 5 Drawing Sheets

AUTOMATIC PRINTING APPARATUS FOR A PACKING CASE CARRIED ON A CONVEYOR BELT UNIT

BACKGROUND OF THE INVENTION

1. Field of the Invention

This invention relates to a printing apparatus, more particularly to an automatic printing apparatus for a packing case that is carried on a conveyer belt unit.

2. Description of the Related Art

When packing cases are moved by a conveyer belt unit to a predetermined position for transportation or storage, some indentifying words are printed manually on each of the packing cases. It is time-consuming to perform this manual printing process.

SUMMARY OF THE INVENTION

Therefore, the main object of this invention is to provide an automatic printing apparatus for a packing case that is carried on a conveyer belt unit.

According to this invention, an automatic printing apparatus is used to print a packing case that is carried on a conveyer belt unit. The printing apparatus includes a lower support unit which is disposed movably on an upright side wall of the conveyer belt unit. A lengthwise-position adjustment device is mounted operatively on the conveyer belt unit and is actuatable so as to move the lower support unit along the length of the conveyer belt unit. An upper support unit is mounted movably on the lower support unit. A height adjustment device is mounted operatively on the lower support unit and is actuatable to move the upper support unit vertically on the lower support unit. A printer support unit is mounted movably on the upper support unit. A feeding hydraulic cylinder has a cylinder body fixed on the upper support unit, and a piston rod mounted movably in the cylinder body of the feeding cylinder body at one end portion thereof and connected securely to the printer support unit at the other end portion thereof. A sensor is installed on the side wall of the conveyer belt unit so as to activate the feeding hydraulic cylinder to move the printer support unit toward the packing case when the sensor detects that the packing case is at a predetermined position on the conveyer belt unit. A printing hydraulic cylinder unit includes a printing hydraulic cylinder carried on the printer support unit, and a printer member disposed between the printing hydraulic cylinder and the packing case. The printing hydraulic cylinder has a cylinder body fixed on the printer support unit, and a piston rod mounted movably in the cylinder body of the printing hydraulic cylinder at one end portion thereof and connected securely to the printer member at the other end portion of the printing hydraulic cylinder. A contact switch is installed on the front end of the printer support unit and is connected functionally to the printing hydraulic cylinder. When the contact switch is moved to contact the packing case, the piston rod of the printing hydraulic cylinder carries the printer member to move toward the packing case so as to print the packing case.

BRIEF DESCRIPTION OF THE DRAWING

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
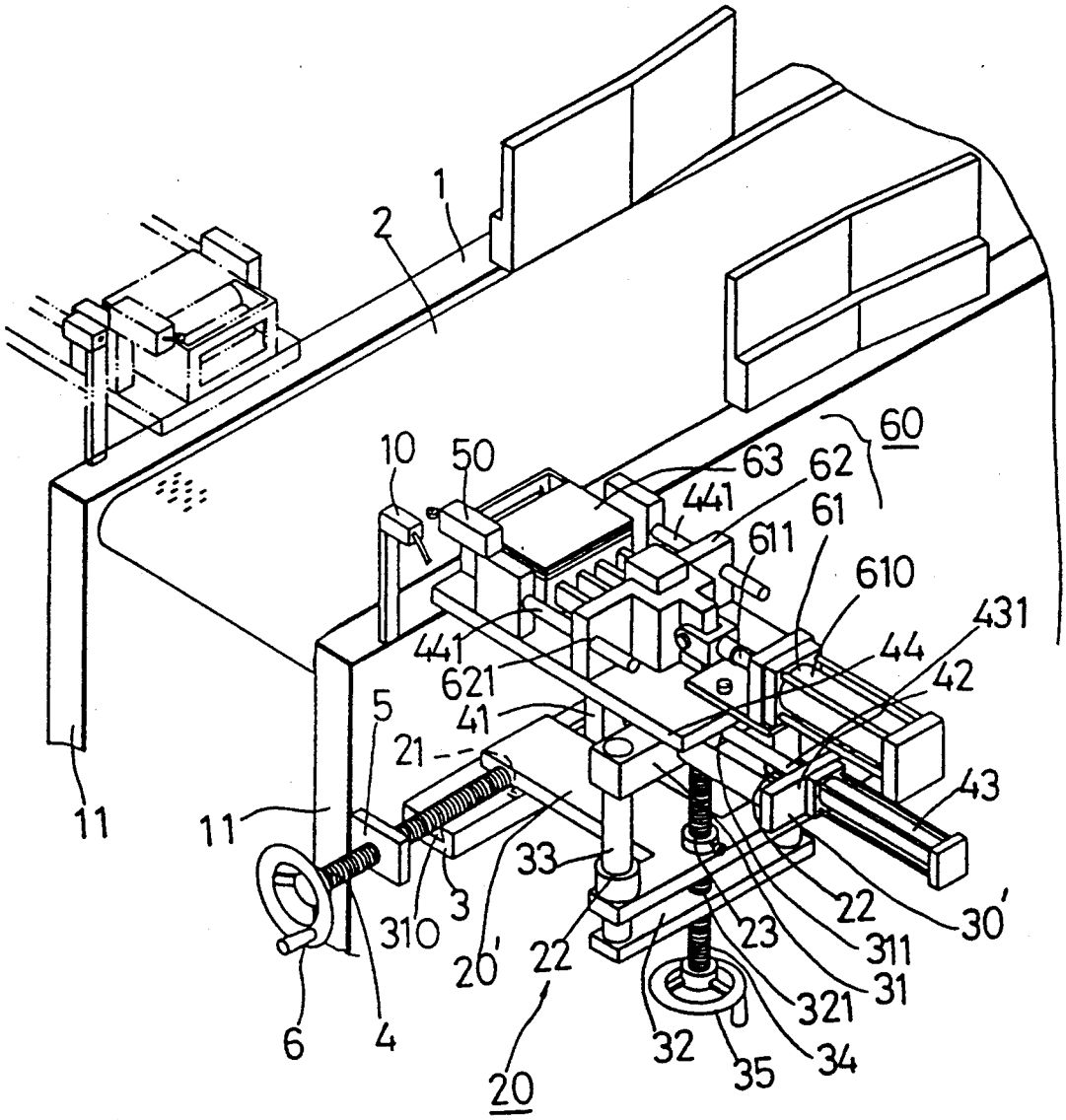
FIG. 1 is a perspective view of an automatic printing apparatus, which is used to mark a packing case that is carried on a conveyer belt unit, according to this invention.

Referring to FIG. 1, an automatic printing apparatus of this invention consists of a printing mechanism that is disposed on a side of a conveyer belt unit (1) which has two upright side walls (11) at two opposite sides thereof. A conveyer belt (2) is interposed between the side walls (11). The printing mechanism includes a sensor (10), a lower support unit (20), a height adjustment device, a feeding assembly, a contact switch (50) and a printing hydraulic cylinder unit (60).

The sensor (10) is installed on a side wall (11) of the conveyer belt unit (1) and is connected functionally to the feeding unit. When a packing case is moved so as to align with the sensor (10), the sensor (10) sends a signal to the feeding unit in order to activate the same for printing. In this embodiment, the sensor (10) is an electric eye.

A fixed plate (3) is mounted securely on the outer side of the side wall (11) and has a horizontal dovetail groove (310) formed in the upper surface thereof.

The lower support unit (20) includes a plate body (20') and a dovetail tongue (21) disposed securely on the bottom surface of the plate body (20'). The dovetail tongue (21) is engaged within the dovetail groove (310) of the fixed plate (3) so as to mount the lower support unit (20) movably on the fixed plate (3). A lengthwise-position adjustment device includes a horizontal adjustment bolt (4) engaged threadably with the threaded hole of a lug (5) which is mounted securely on the side wall (11). An end of the horizontal adjustment bolt (4) is engaged threadably within the threaded hole of the fixed plate (3). A first hand wheel (6) is connected securely to the other end of the horizontal adjustment bolt (4) and is actuatable so as to move the plate body (20') on the fixed plate (3) along the length of the conveyer belt unit (1). An upper support unit is carried on the upper end of the height adjustment device and consists of a U-shaped frame (30') (see FIG. 1) and a rectangular frame which includes an upper horizontal bar (31), a lower horizontal bar (32) and two vertical guide rods (33) which interconnect the upper and lower horizontal bars (31, 32). The guide rods (33) extend through the guide holes (22) of the plate body (20'). The U-shaped frame (30') is connected securely to the rectangular frame.

Figure 5:
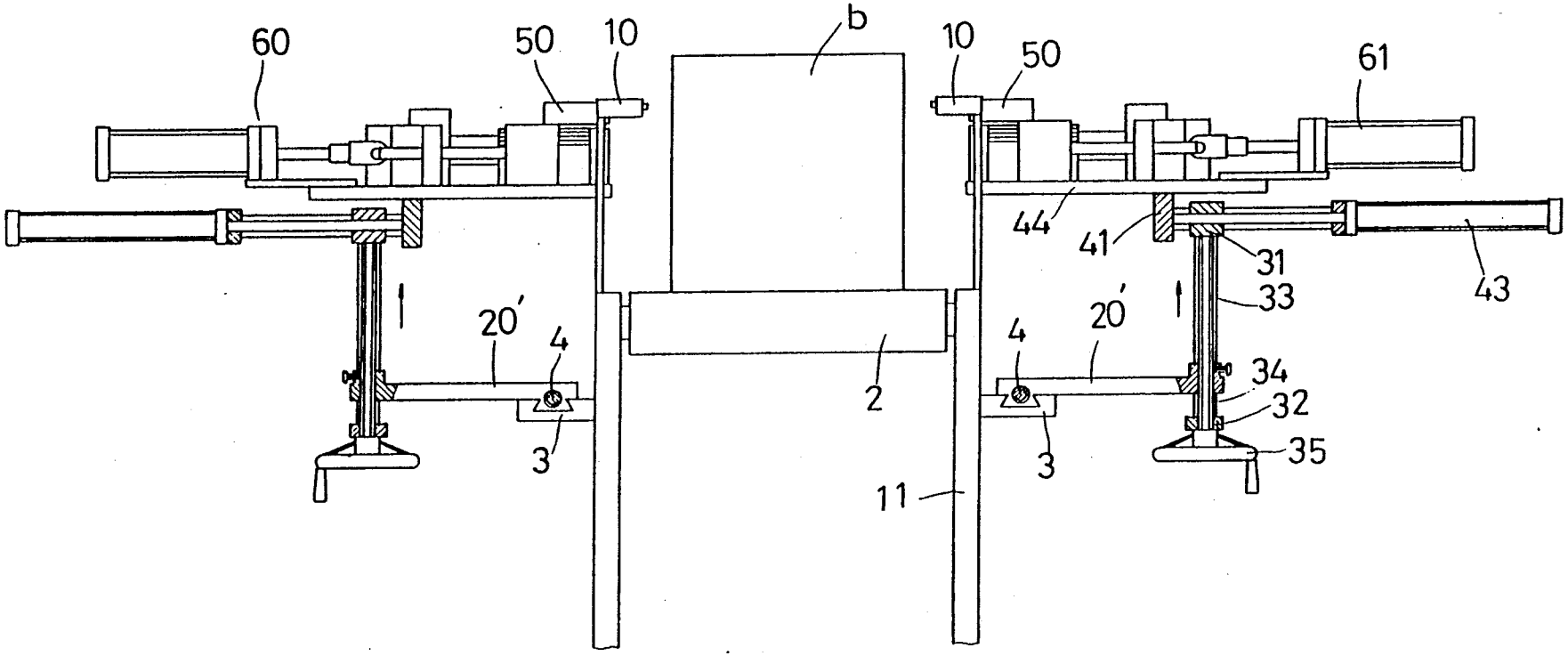
FIG. 5 is a schematic view illustrating how the the height of the printer member of the automatic printing apparatus of FIG. 2 is adjusted.

The height adjustment device includes a vertical adjustment bolt (34) which extends through the middle hole (321) of the lower horizontal bar (32) and the threaded hole (23) of the plate body (20'). The upper end of the vertical adjustment bolt (34) is engaged threadably within the threaded holes of the upper horizontal bar (31). A second hand wheel (35) is connected securely to the lower end of the vertical adjustment bolt (34) and is actuatable so as to move the upper horizontal bar (31) vertically on the lower support unit (20) between the positions shown in FIGS. 2 and 5.

The feeding assembly includes a printer support unit and a feeding hydraulic cylinder. The printer support unit consists of a horizontal support bar (41) and a horizontal plate (44) fixed on the top surface of the horizontal support bar (41). The feeding hydraulic cylinder has a cylinder body (43) fixed on the U-shaped frame (30'), and a piston rod (431) mounted movably in the cylinder body (43) at the rear end portion thereof and connected securely to the horizontal support bar (41) at the front end portion thereof. The upper horizontal bar (31) has a middle hole (311) through which the piston rod (431) extends. The feeding hydraulic cylinder can move the horizontal support bar (41) between the positions shown in FIGS. 2 and 3.

Figure 4:
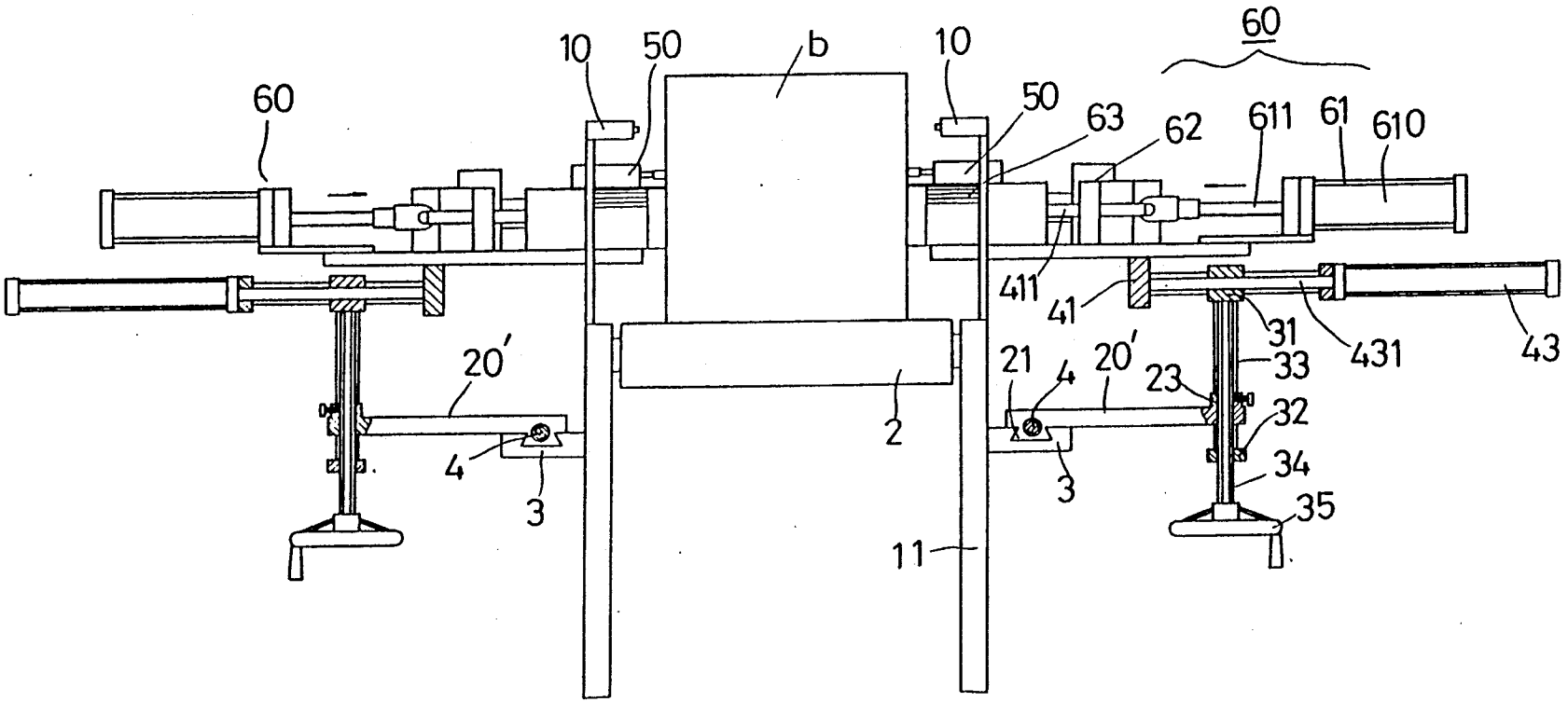
FIG. 4 is a schematic view illustrating the operation of the printing hydraulic cylinder of the automatic printing apparatus of FIG. 2.

The printing hydraulic cylinder unit (60) includes a printing hydraulic cylinder (61), a printer push plate (62) and a printer member (63). The printing hydraulic cylinder (61) has a cylinder body (610) fixed on the horizontal plate (44), and a piston rod (611) mounted movably in the cylinder body (610) at the rear end portion thereof and connected securely to the printer push plate (62) at the front end portion thereof. The printing hydraulic cylinder (61) can move the printer member (63) between the positions shown in FIGS. 2 and 4.

The contact switch (50) is installed on the front end portion of the horizontal plate (44). Two horizontal guide rods (441) are fixed on the horizontal plate (44) and extend through the guide holes (621) of the printer push plate (62) so as to guide the printer push plate (62) to move transversely relative to the conveyer belt unit (1), thereby impelling the printer member (63) toward the conveyer belt unit (1) for printing.

When it is desired to print two opposite sides of the packing case, another similar printing mechanism (indicated by the phantom lines in FIG. 1) may be provided on the conveyer belt unit (1) in such a manner that the printing mechanisms are located on two opposite sides of the conveyer belt unit (1). As shown in FIGS. 2, 3, 4 and 5, the printing mechanisms are similar to each other in construction and are interconnected by an electrical connection which is interposed between the contact switches (50). The electrical connection is designed so that the printing hydraulic cylinders (61) can be activated only when both of the contact switches (50) contact simultaneously the packing case (b).

Figure 2:
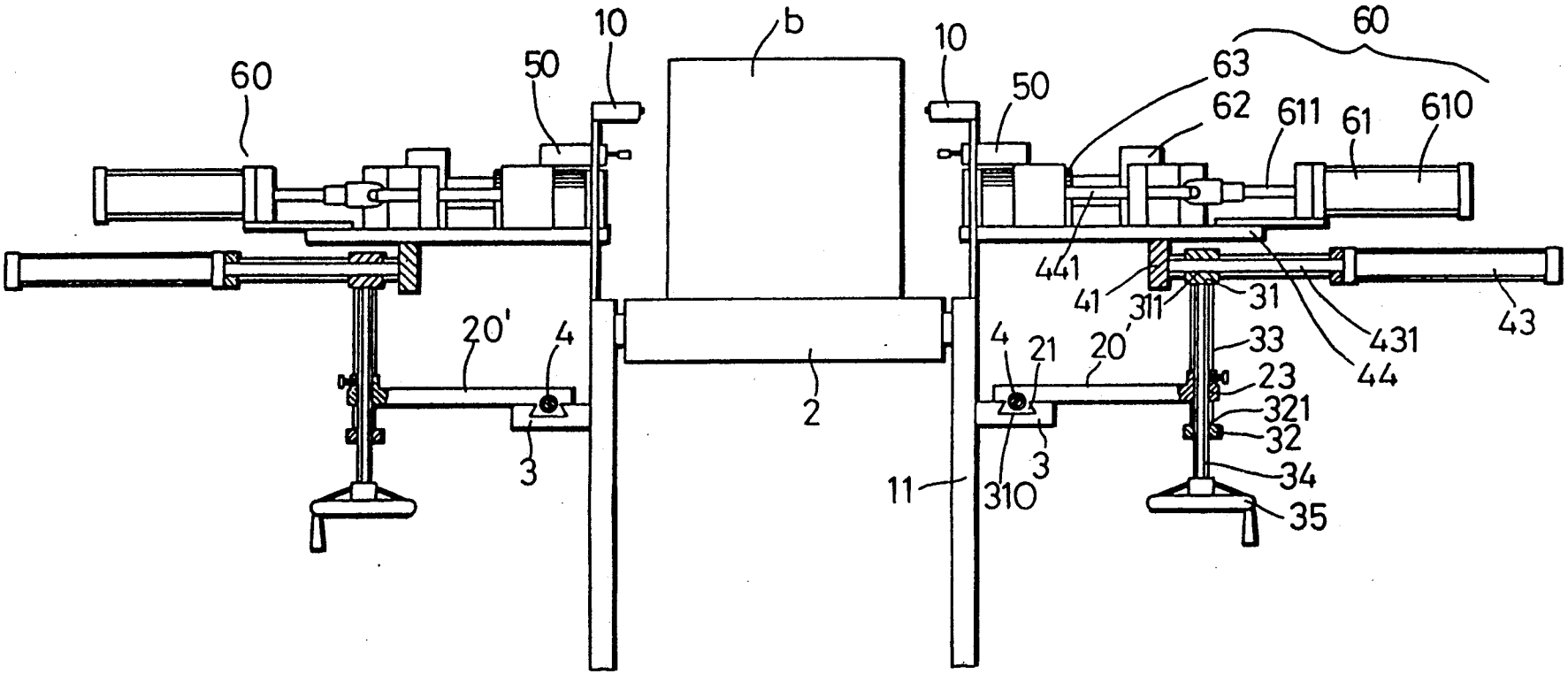
FIG. 2 is a sectional view showing another automatic printing apparatus of this invention.
Figure 3:
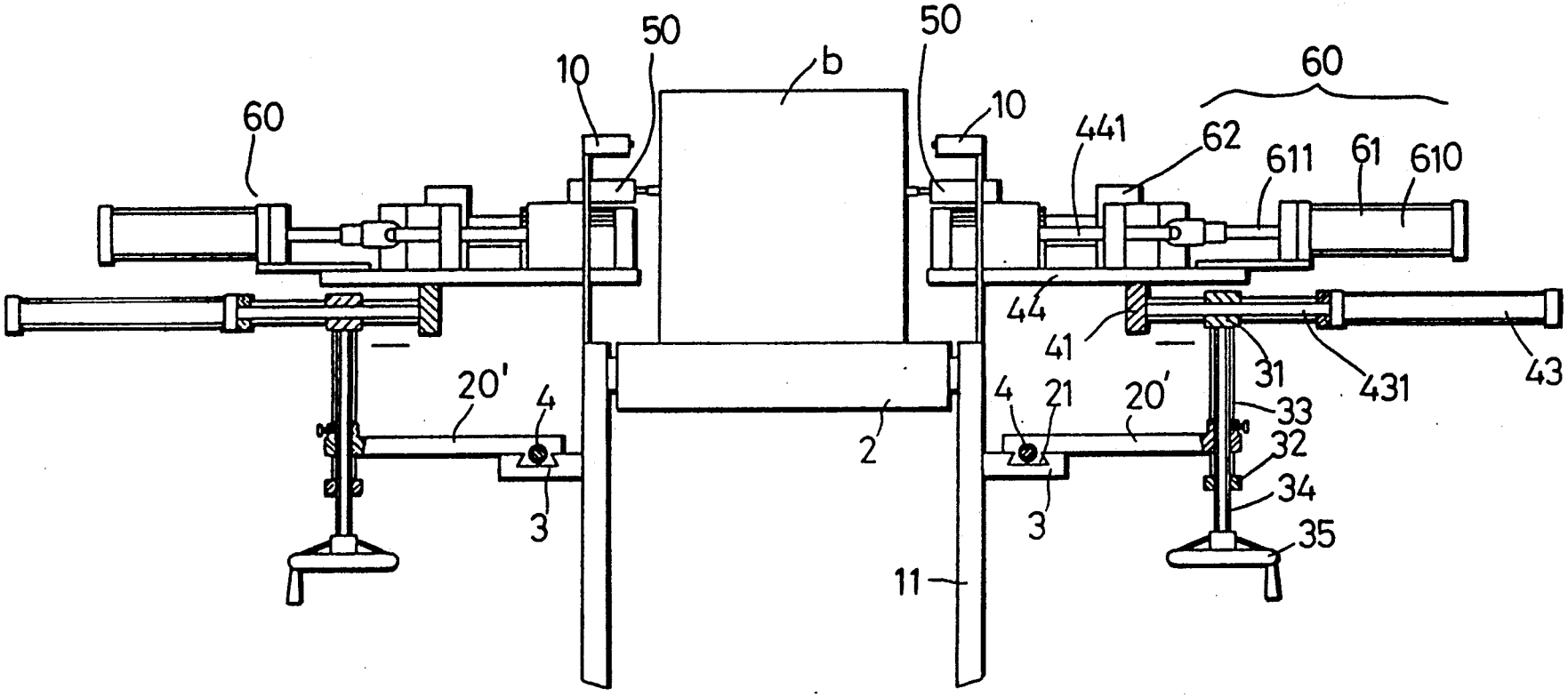
FIG. 3 is a schematic view illustrating the operation of the feeding hydraulic cylinder of the automatic printing apparatus of FIG. 2.

In operation, when the packing case (b) is moved to the position shown in FIG. 2 on the conveyer belt (2), in which the packing case (b) is located between the printing mechanisms, the sensors (10) send a signal to the feeding hydraulic cylinders so as to move the horizontal support bar (41) and the horizontal plate (44) toward the packing case (b) until the contact switches (50) contact the packing case (b). The contacts switches (50) activate the printing hydraulic cylinders (61) so as to move the printing member (63) toward the packing case (b) for printing. When the packing case (b) is not placed accurately on the middle portion of the conveyer belt (2), the contact switches (50) cannot contact simultaneously the packing case (b), and thus, the printing hydraulic cylinders (61) cannot be activated. Accordingly, the identifying words can be printed on two opposite sides of the packing case (b) in an orderly manner by means of the automatic printing apparatus of this invention.

With this invention thus explained, it is apparent that numerous modifications and variations can be made without departing from the scope and spirit of this invention. It is therefore intended that this invention be limited only as indicated in the appended claims.

I claim:

1. An automatic printing apparatus for a packing case carried on a conveyer belt unit, said conveyer belt unit having first and second upright side walls which are located at two sides thereof, said printing apparatus comprising a first printing mechanism disposed on said first upright side wall of said conveyer belt unit, said first printing mechanism including:

a lower support unit disposed movably on said first upright side wall of said conveyer belt unit;

a lengthwise-position adjustment device mounted operatively on said conveyer belt unit and actuatable so as to move said lower support unit along a length of said conveyer belt unit;

an upper support unit mounted movably on said lower support unit;

a height adjustment device mounted operatively on said lower support unit and actuatable so as to move said upper support unit vertically on said lower support unit;

a printer support unit mounted movably on said upper support unit;

a feeding hydraulic cylinder having a cylinder body fixed on said upper support unit, and a piston rod mounted movably in said cylinder body of said feeding cylinder body at one end portion thereof and connected securely to said printer support unit at the other end portion thereof;

a sensor installed on said first upright side wall of said conveyer belt unit so as to activate said feeding hydraulic cylinder to move said printer support unit toward said packing case when said sensor detects that said packing case is at a predetermined position on said conveyer belt unit;

a printing hydraulic cylinder unit including a printing hydraulic cylinder carried on said printer support unit, and a printer member disposed between said printing hydraulic cylinder and said packing case, said printing hydraulic cylinder having a cylinder body fixed on said printer support unit, and a piston rod mounted movably in said cylinder body of said printing hydraulic cylinder at one end portion thereof and connected securely to said printer member at the other end portion thereof; and a contact switch installed on a front end of said printer support unit and connected functionally to said printing hydraulic cylinder in such a manner that, when said contact switch is moved to contact said packing case, said piston rod of said printing hydraulic cylinder carries said printer member to move toward said packing case so as to print said packing case.

* * * * *